US010986447B2

(12) United States Patent
Malsky et al.

(10) Patent No.: US 10,986,447 B2
(45) Date of Patent: Apr. 20, 2021

(54) DOPPLER COMPENSATION IN COAXIAL AND OFFSET SPEAKERS

(71) Applicant: Analog Devices, Inc., Norwood, MA (US)

(72) Inventors: Kenneth Malsky, Bedford, MA (US); Young Han Kim, Wilmington, MA (US); Miguel A. Chavez, Cambridge, MA (US)

(73) Assignee: ANALOG DEVICES, INC., Wilmington, MA (US)

( * ) Notice: Subject to any disclaimer, the term of this patent is extended or adjusted under 35 U.S.C. 154(b) by 0 days.

(21) Appl. No.: 16/448,994

(22) Filed: Jun. 21, 2019

(65) Prior Publication Data

US 2020/0404420 A1 Dec. 24, 2020

(51) Int. Cl.

*H04R 3/14* (2006.01)
*H04R 1/28* (2006.01)
*H04R 3/04* (2006.01)

(52) U.S. Cl.

CPC ..... *H04R 3/14* (2013.01); *H04R 1/2803* (2013.01); *H04R 3/04* (2013.01)

(58) Field of Classification Search

CPC ... H04R 3/14; H04R 3/04; H04R 3/12; H04R 3/08; H04R 1/2803; H04R 1/26; H04R 1/24; H04R 5/02; H04R 7/16; H04R 7/20; H04R 9/06; H04R 9/025; H04R 9/02; H04R 9/063; H04R 9/045; H04R 9/041; H04R 9/043; H04R 9/04; H04R 9/046; H04R 2400/03; H04S 7/307; H03G 5/165; H03G 5/025; H03G 5/005

USPC ..... 381/99, 98, 396, 405, 403, 402, 401

See application file for complete search history.

(56) References Cited

U.S. PATENT DOCUMENTS

| | | | | |
|---|---|---|---|---|
| 4,283,606 | A * | 8/1981 | Buck | H04R 1/24 181/144 |
| 4,421,949 | A | 12/1983 | Eberbach | |
| 4,619,342 | A * | 10/1986 | Buck | H04R 9/063 181/144 |
| 4,769,848 | A * | 9/1988 | Eberbach | H03H 7/32 381/97 |
| 4,885,782 | A * | 12/1989 | Eberbach | H04R 1/26 381/186 |
| 6,584,205 | B1 | 1/2003 | Croft, III et al. | |
| 8,467,557 | B2 * | 6/2013 | Miller | H04R 1/24 381/182 |
| 2005/0094829 | A1 * | 5/2005 | Cordell | H04R 3/08 381/103 |
| 2012/0033818 | A1 * | 2/2012 | De Poortere | H04R 3/14 381/17 |
| 2016/0105742 | A1 * | 4/2016 | Gautama | H04R 1/22 381/99 |

(Continued)

*Primary Examiner* — Ahmad F. Matar
*Assistant Examiner* — Sabrina Diaz
(74) *Attorney, Agent, or Firm* — Patent Capital Group

(57) ABSTRACT

There is disclosed in one example an audio processor, including: an audio crossover to separate a first frequency band from a second frequency band, the first frequency band having a lower frequency band than the second frequency band; an excursion estimator to estimate from information of the first frequency band a predicted excursion of a low-frequency driver; an interpolator to interpolate an adjustment to the second frequency band to compensate for the estimated excursion; and circuitry to drive the adjusted second frequency to a receiver.

39 Claims, 11 Drawing Sheets

(56) References Cited

U.S. PATENT DOCUMENTS

| | | | | |
|---|---|---|---|---|
| 2016/0173983 | A1* | 6/2016 | Berthelsen | H03G 9/025 381/55 |
| 2016/0216367 | A1 | 7/2016 | Phillips et al. | |
| 2017/0013348 | A1* | 1/2017 | Arneson | H04R 3/14 |
| 2017/0134857 | A1* | 5/2017 | Zurek | H04R 3/14 |
| 2018/0136899 | A1* | 5/2018 | Risberg | H04R 3/002 |

* cited by examiner $$\frac{V_c(S)}{i_c(S)} = Re + sLe(x) + \frac{Bl(x)^2}{s^2Mms + sRms + Kms(x)}$$

DOPPLER COMPENSATION IN COAXIAL AND OFFSET SPEAKERS

FIELD OF THE DISCLOSURE

This application relates to the field of audio signal processing, and more particularly to providing Doppler compensation in coaxial and offset speakers.

BACKGROUND

Consumers of audio products expect high quality audio and linear response from audio processing applications.

BRIEF DESCRIPTION OF THE DRAWINGS

The present disclosure is best understood from the following detailed description when read with the accompanying FIGURES. It is emphasized that, in accordance with the standard practice in the industry, various features are not drawn to scale and are used for illustration purposes only. In fact, the dimensions of the various features may be arbitrarily increased or reduced for clarity of discussion.

SUMMARY

Figure 1A:
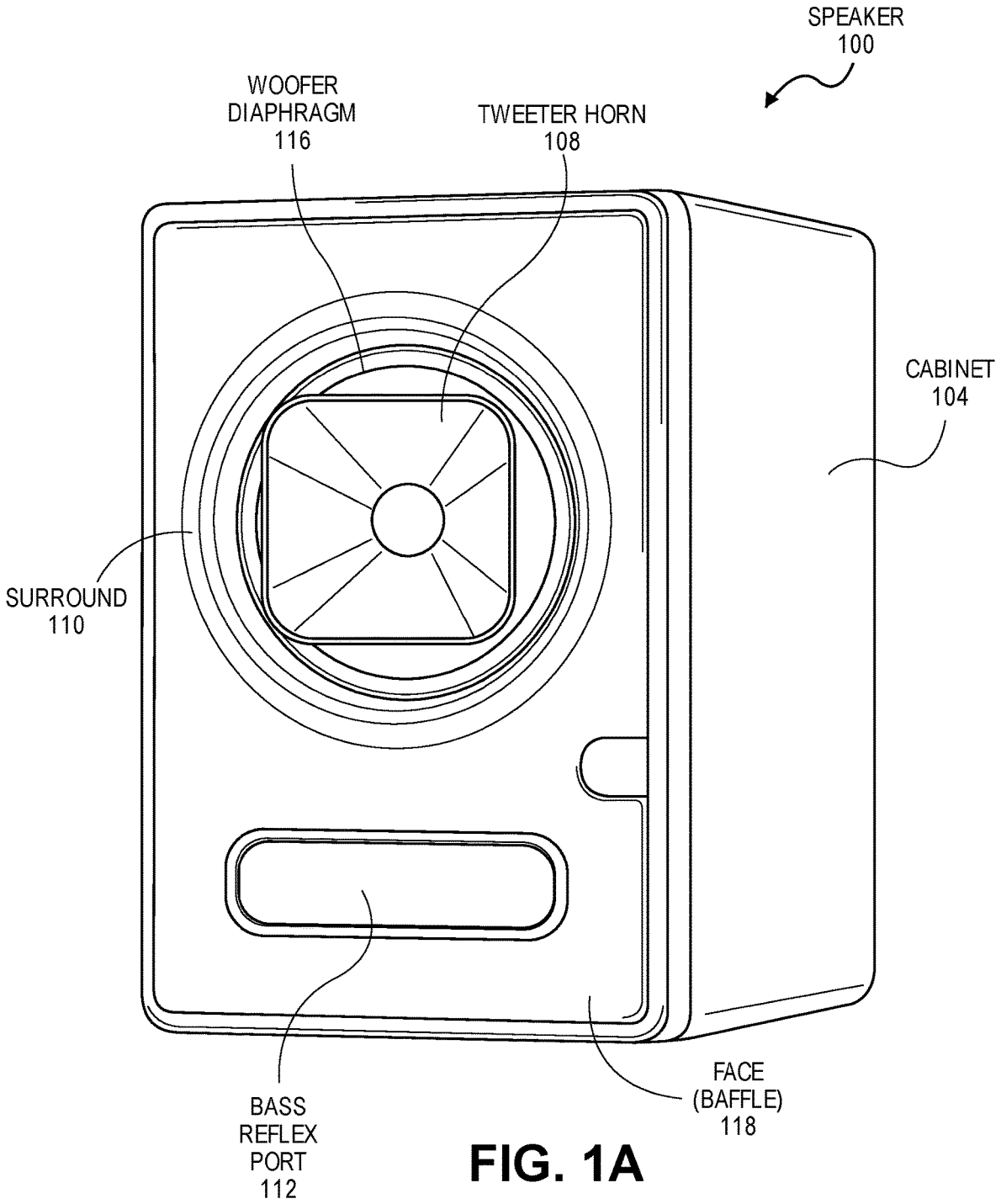
FIG. 1A is an external perspective view of a loudspeaker that may be configured with coaxial or concentric drivers.

In an example, there is disclosed an audio processor, comprising: an audio crossover to separate a first frequency band from a second frequency band, the first frequency band having a lower frequency band than the second frequency band; an excursion estimator to estimate from information of the first frequency band a predicted excursion of a low-frequency driver; an interpolator to interpolate an adjustment to the second frequency band to compensate for the estimated excursion; and circuitry to drive the adjusted second frequency to a receiver.

EMBODIMENTS OF THE DISCLOSURE

The following disclosure provides many different embodiments, or examples, for implementing different features of the present disclosure. Specific examples of components and arrangements are described below to simplify the present disclosure. These are, of course, merely examples and are not intended to be limiting. Further, the present disclosure may repeat reference numerals and/or letters in the various examples. This repetition is for the purpose of simplicity and clarity and does not in itself dictate a relationship between the various embodiments and/or configurations discussed. Different embodiments may have different advantages, and no particular advantage is necessarily required of any embodiment.

In broad terms, a speaker is an electromechanical system that reproduces sound. The speaker has a cone or diaphragm that has a characteristic moving mass that may be measured in grams, and a characteristic suspension stiffness that may be measured, for example, in newtons per millimeter.

A driver motor causes oscillations of the diaphragm or cone at a given frequency, which causes the cone to generate mechanical waves in the air or other transmission medium, which are perceptible as sound. The driver motor may include a strong magnet and a voice coil, which can be excited by electrical inputs. The electrical inputs to the voice coil generate a varying magnetic field, which attracts or repulses the field of the magnet moving the diaphragm at the desired frequency, thus generating sound at a selected frequency.

One fundamental difficulty in speaker design is that different sizes of cones are more suited for generating different frequencies. For example, in reproducing human-perceptible music, it may be necessary to reproduce frequencies in the range of approximately $10^1$ hertz (Hz) up to approximately $10^4$ Hz. Lower frequencies (e.g., in the range 20 to 500 Hz) are better generated by a larger cone displacing a larger acoustic mass. On the other hand, frequencies above 500 Hz, and particularly those in the range of 2 to 20 kHz, are better generated by a smaller cone operating at the higher frequency.

The "holy grail" of speaker design is complete linear response. In other words, a perfect speaker can produce the entire range of audible frequencies without distortion. To date, there is no known speaker driver design capable of perfectly producing such a wide frequency range. Certain drivers can be optimized for certain frequency ranges, but in general, the more aggressively it is optimized at one range, the more distortion there will be at other ranges. To compensate for this reality, many high-end speakers include separate "woofers" that are optimized specifically for low-frequency to mid-frequency ranges, and separate "tweeters" optimized for the higher frequency ranges. Some speaker systems also include separate mid-range speakers, and in the general case, the human-perceptible audio spectrum (or "human hearing range," from approximately 20 Hz to approximately 20,000 Hz) can be divided into any number of sub-ranges, with specialized drivers for each sub-range.

When speakers provide separate drivers, such as separate woofers and tweeters, a wider frequency range of sound reproduction can be realized. Specifically, an input audio signal can be split into separate components, with the high-frequency signal being directed to the tweeters, and the low to mid-frequency signals being directed to the woofers.

A common configuration for speakers with separate audio ranges is an offset configuration. For example, a cabinet speaker may have a large woofer, with an axially offset tweeter. While this results in a more linear frequency response across the range of human hearing, it also results in a disadvantage. Ideally, from a human user's perspective, the sound would appear to emanate from a single point source. When the speakers are offset, the sound is not perceived as emanating from a single point source, and thus, despite the wider response, the human user still experiences some distortion in the reproduced sound.

There are several solutions to this issue. One solution is a concentric or coaxial speaker configuration. In this configuration, a separate tweeter is disposed in the center of a larger woofer. Although the woofer and the tweeter still independently generate their own audio frequency ranges, because they are concentric, the audio appears more closely to emanate from a single point. Another solution is simply to have a single driver. This again realizes the single point source target more correctly than the offset speaker configuration, but at the expense of producing the full range of frequencies.

All of the configurations described above—offset speakers, concentric speakers, and single-driver speakers—are susceptible to so-called Doppler distortion. The Doppler effect is well-known in both mechanical and electromagnetic wave theory. Put very simply, when a wave source is moving toward an observer, the waves appear to be compressed from the viewpoint of the observer (shorter waves, higher frequency), with the magnitude of compression varying directly with the speed at which the wave source is approaching. When the wave source is moving away from the observer, the waveform appears to be expanded from the viewpoint of the observer (longer waves, lower frequency), with the magnitude of expansion varying directly with the speed at which the wave source is moving away from the observer. In electromagnetic wave theory, this is known as "blue shift" for electromagnetic wave sources moving toward the observer, and "red shift" for electromagnetic wave sources moving away from the observer. In the case of mechanical waves such as sound, the effect is easily and commonly explained in terms of an ambulance. When an ambulance is approaching the observer, the mechanical waves are compressed by the incoming speed of the ambulance, and the ambulance siren appears to the stationary observer to have a higher pitch until the ambulance reaches the observer. At the exact moment that the ambulance reaches the observer, the ambulance siren has no frequency shift, and for that instant, the observer hears the siren frequency at its "true" frequency. As the ambulance then moves away from the observer, the frequency waveform is expanded proportional to the speed of the ambulance, and the pitch of the siren appears to go lower as the mechanical wave appears to have a lower frequency proportional to the speed of the ambulance.

Put in its simplest terms, the Doppler effect postulates that when a waveform source is moving with respect to an observer, the waveform will experience some frequency distortion with respect to that observer. This effect comes into play in all of the speaker types disclosed in this specification.

In the simple example of a single-driver speaker intended to reproduce audio across the full human hearing range, the diaphragm generates sound waves that are perceptible to a human user. However, the diaphragm generates these sound waves by moving back and forth. Because the sound source is moving, there is naturally a Doppler effect. In the case of a single-range woofer, the effect is mitigated by the fact that the range of motion for the driver is relatively small compared to the wavelength of the bass frequencies. Thus, there is minimal human-perceptible distortion in the bass waveform. In the case of a single-range tweeter, there is also minimal human-perceptible distortion. In this case, although the driver is moving back and forth at a very high frequency, the driver experiences very little displacement, and in fact negligible displacement in comparison to the displacement of a woofer. Thus, because the driver is moving very little, there is very little frequency distortion. However, in the case of a full-range driver, where the driver is producing both low frequencies that require large displacement and with high frequencies superimposed, modulation of the higher frequencies can be substantial.

Consider, for example, a driver that is reproducing a bass waveform at 20 Hz, while also reproducing a treble waveform at 20 kilohertz (kHz). In other words, for every vibration of the cone to reproduce the 20 Hz signal, the cone vibrates a thousand times for the 20 kHz waveform. To simplify the model, consider that as the driver moves forward, it vibrates five hundred times to reproduce the high-frequency waveform. Then, as it moves backward, it vibrates five hundred times to further generate the high-frequency waveform, and then continues this motion back and forth. In this case, half of the high-frequency waves will be perceived at a higher pitch and half at a lower pitch than that of the electrical stimulus. This can be human-perceptible, because the displacement of the speaker to generate the low-frequency waveform is much greater than the displacement of the speaker to generate the high-frequency waveform. This causes a substantial Doppler shift in the high-frequency waveform, which can result in substantial human-perceptible distortion in the high-frequency signal.

Although the mechanisms are different, there is also human-perceptible distortion in the case of a concentric speaker or of an offset speaker.

In the case of concentric drivers, the low-frequency driver and the high-frequency driver act independently of one another, even though they sit coaxial to one another. Thus, the high-frequency driver is not moving back and forth with the low-frequency driver as the low-frequency driver is generating its low-frequency waveform. But because the low-frequency driver surrounds the high-frequency driver, the waveform of the high-frequency driver reflects off the cone of the low-frequency driver. This reflection alone can cause distortion, but the distortion is aggravated when the surface that the frequencies are reflecting off of is itself moving. A similar result can occur in the case of offset speakers. In that case, although the drivers are not coaxial to one another, a portion of the high-frequency waveform can still be expected to reflect off of the moving low-frequency driver, thus causing distortion.

The present specification focuses primarily on a method and control circuit to compensate for Doppler distortion in coaxial or offset speakers, wherein a separate high-frequency driver ("a tweeter") generates a waveform that may reflect off of the moving surface of a low-frequency driver ("a woofer"). This can include the use of a crossover network that identifies a division between the two signal sets. The teachings of the present specification illustrate an example where two independent drivers are used, specifically a mid to low-frequency woofer and a high-frequency tweeter. A crossover point is generally identified in such a system at somewhere between $10^2$ and $10^3$ Hz in frequency, typically in the 1 to 3 kHz range. There is usually a relatively sharp drop-off in each driver's response at this crossover frequency range, and the input audio signal is divided at this crossover frequency. Tones below the crossover frequency are driven to the woofer, while tones higher than the crossover frequency are driven to the tweeter. Note that in more complicated systems that include more drivers for more audio ranges, a plurality of crossover frequencies may be identified, and the input audio signal may be further subdivided. The low-frequency signal may be provided directly to the woofer without any modification or conditioning, at least not with respect to Doppler distortion. Other signal conditioning may be applied such as, for example, active noise cancellation. The high-frequency component is not fed directly to the tweeter, but rather information from the low-frequency component is first used to anticipate the distortion that will be experienced by the high-frequency signal due to the Doppler effect. The high-frequency signal is then conditioned to compensate for this Doppler distortion before it is driven to the tweeter. For example, if the movement of the woofer is expected to shift the perceived frequency of the high-frequency waveform by 500 Hz, then the frequency driven to the tweeter may be reduced by 500 Hz to compensate for the anticipated change. In some cases, time shifting may also be applied to the high-frequency audio signal to compensate for misalignment of the acoustic centers of the drivers or accelerations that may be caused by reflecting off of the woofer.

In the case of coaxial or offset speakers described herein, the high-frequency treble waveforms are modulated by their reflection off of the low-frequency driver. One method of compensating for this modulation, as described herein, is to use a software model of the existing crossover circuit to identify high-frequency waves that will reflect off of the bass cone. This may also include using a physical model of the loudspeaker, itself. For example, the physical model may account for the size and location of the various drivers in the loudspeaker system. Note that with existing loudspeaker systems with separate woofers, tweeters, and possibly mid-range speakers, there may already be a crossover circuit, which may be a two-way or three-way crossover circuit to separate the audio signal into two or three components, respectively. A software model of this crossover can be used to model how the frequencies will interact with one another in the known speaker system. Specifically, information about the high-frequency signal and its expected interaction with the woofer can be provided to the high-frequency driver. A predistortion may be inserted into the signal to the high-frequency driver with the intended effect of canceling out or mitigating the reflected high-frequency waves.

A system and method for providing Doppler compensation in coaxial and offset speakers will now be described with more particular reference to the attached FIGURES. It should be noted that throughout the FIGURES, certain reference numerals may be repeated to indicate that a particular device or block is wholly or substantially consistent across the FIGURES. This is not, however, intended to imply any particular relationship between the various embodiments disclosed. In certain examples, a genus of elements may be referred to by a particular reference numeral ("widget 10"), while individual species or examples of the genus may be referred to by a hyphenated numeral ("first specific widget 10-1" and "second specific widget 10-2").

FIG. 1A is a perspective external view of a loudspeaker 100 that may be configured with coaxial or concentric drivers. Loudspeaker 100 represents a class of loudspeakers that may include coaxial or concentric drivers, or in some cases a single driver. For purposes of the examples provided in the present specification, loudspeaker 100 represents an embodiment including a separate coaxial woofer and tweeter.

In this example, loudspeaker 100 is encased within a cabinet 104. Cabinet 104 may be constructed of any suitable, rigid material, such as plastic, wood, metal, or other rigid material. Cabinet 104 provides a physical structure for loudspeaker 100, and also provides an acoustic volume behind the drivers. Encased within a face of cabinet 104 is a driver including a surround 110, which surrounds the driver.

A tweeter horn 108 is illustrated, as well as a woofer diaphragm 116. In the case of coaxial or concentric speakers, a plurality of diaphragms may be nested within one another, as is more clearly illustrated in FIG. 2A. A dust cap may cover the voice coil and motor, to prevent dust or other contamination from entering the system.

Loudspeaker 100 is illustrated with a bass reflex port 112. This bass reflex configuration is popular in contemporary loudspeaker design, as it provides a richer and deeper bass experience. Bass reflex port 112 provides a Helmholtz resonance for the low-frequency driver of loudspeaker 100. A Helmholtz resonator uses an air mass to provide greater acoustic output at low frequencies.

The area within cabinet 104 provides an acoustic volume that is vented by bass reflex port 112. Bass reflex port 112 may connect to a pipe or a duct, which may typically have a circular or rectangular cross-section. The mass of the air and the "springiness" of its inertia form a mechanical resonance, and thus provides a Helmholtz resonance at selected bass frequencies. This augments the bass response of the driver and may extend the frequency response of the driver/enclosure combination to frequencies below the range that the driver would be able to reproduce in a sealed box.

Figure 1B:
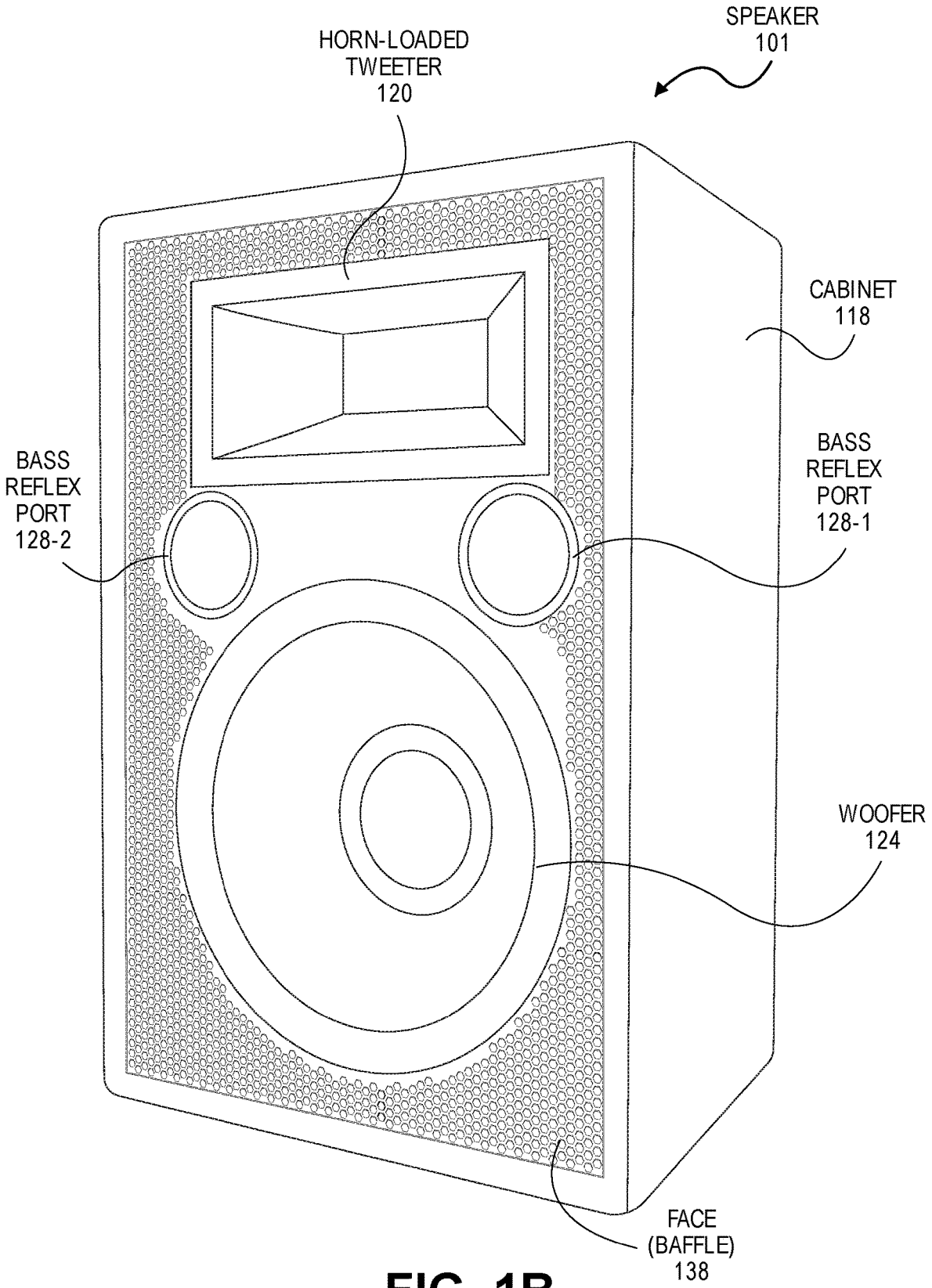
FIG. 1B is a further external perspective view of a loudspeaker.

FIG. 1B is an external perspective view of a loudspeaker 101 that may be configured for use with offset drivers. Loudspeaker 101 is similar to loudspeaker 100 of FIG. 1A. For example, loudspeaker 101 includes a cabinet 118, and bass reflex ports 128-1 and 128-2 respectively. This embodiment also includes an offset horn-loaded tweeter 120, which is not coaxial or concentric with woofer 124.

As discussed above, either one of these configurations may result in modulation, particularly modulation of the high-frequency waveforms from the tweeter as they are reflected off of the moving woofers. Not only does the reflection itself cause a modulation or distortion, but because the woofer experiences very large excursions as compared to the tweeters, the moving surface of the woofer causes an acceleration of the reflected treble waveforms. This can be experienced as a substantial distortion on the part of a human user listening to loudspeaker 100 of FIG. 1A or loudspeaker 101 of FIG. 1B. This distortion in the treble waveforms can lead to a somewhat unpleasant listening experience, with the treble sounding skewed and/or out of tune with the mid-frequency and bass waveforms. As discussed above, it is therefore desirable to provide some pre-modulation that can help to limit the effect of the distortion on the audio waveforms.

Figure 2A:
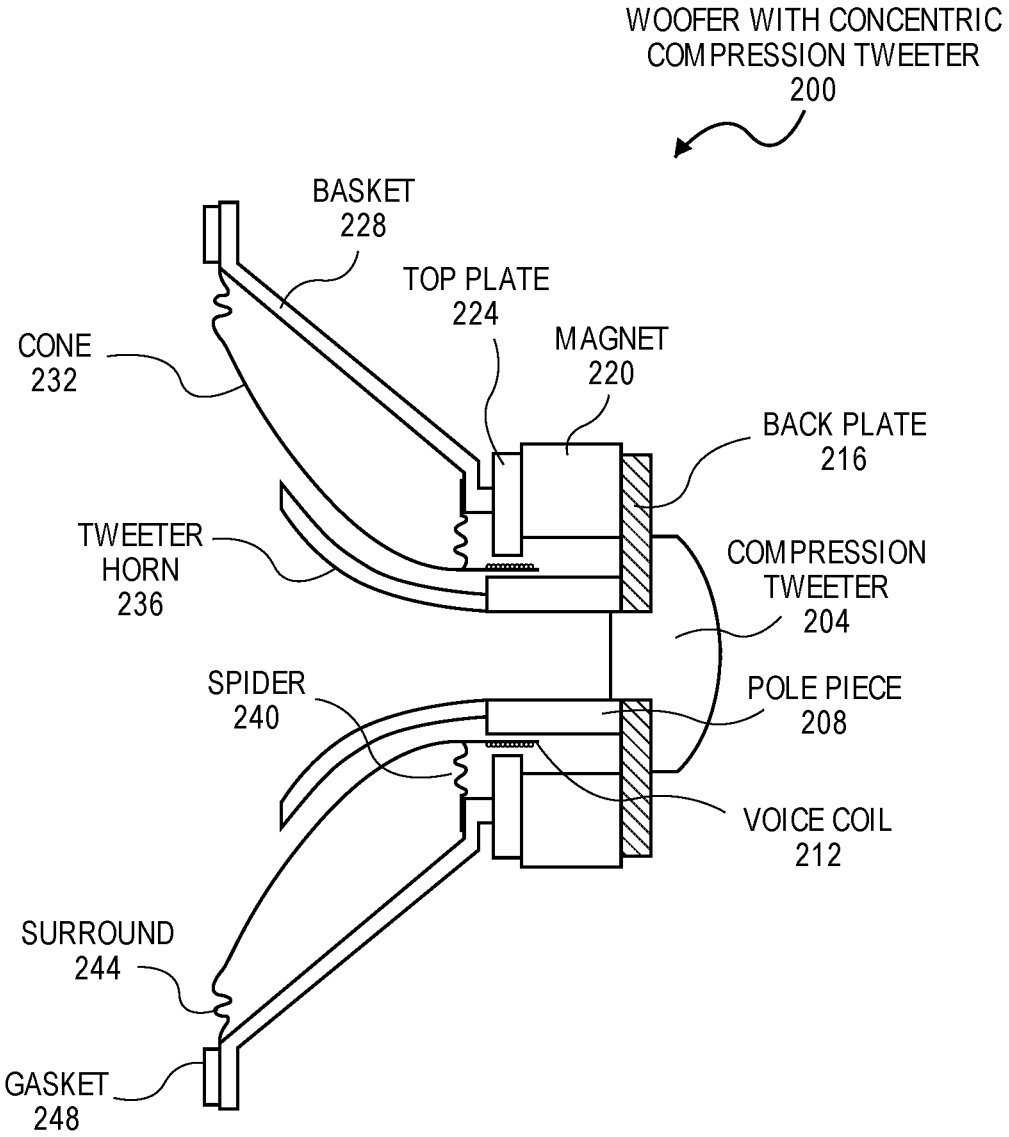
FIG. 2A is a perspective view of a coaxial speaker system, specifically a woofer with concentric compression tweeter.
Figure 2B:
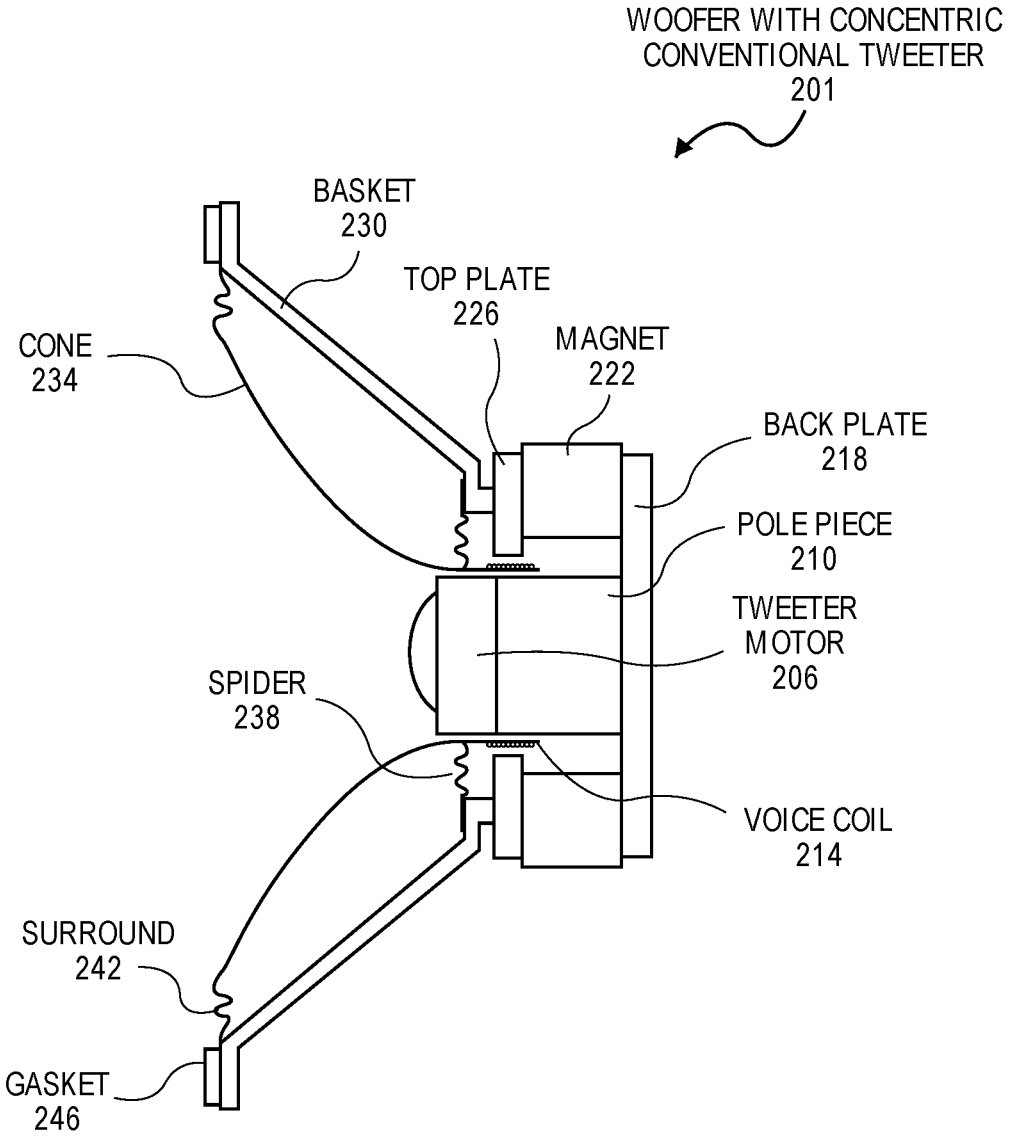
FIG. 2B is a block diagram of a concentric speaker system, specifically a woofer with a concentric conventional tweeter.
Figure 2C:
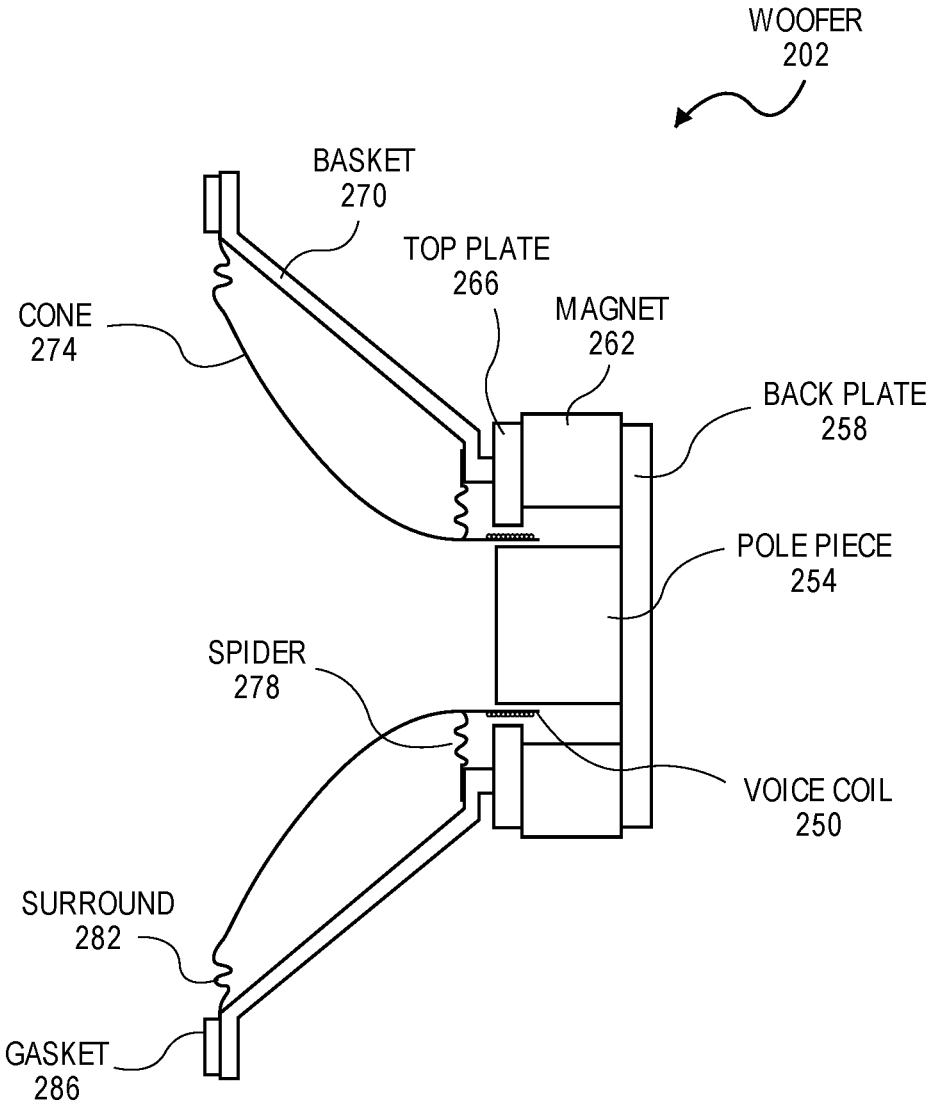
FIG. 2C is a block diagram illustrating a lone woofer, which may be used in configurations where the woofer and tweeter are offset from one another.

FIGS. 2A and 2B illustrate two embodiments of a coaxial speaker designs, while FIG. 2C illustrates a non-concentric woofer.

FIG. 2A is a perspective view of a coaxial speaker system 200, specifically a woofer with concentric compression tweeter. Coaxial speaker system 200 includes independent, coaxial high-frequency and low-frequency drivers.

Coaxial speaker system 200 includes a medium to low-frequency driver (woofer), with a high-frequency driver (compression tweeter 204) nested within the woofer. The two drivers operate independently of one another, providing separate bass and treble frequency ranges. The concentric configuration helps to provide a closer approximation of the acoustic ideal of a point source in free space.

In this configuration, compression tweeter 204 includes a magnet 220, driven by a voice coil 212. Voice coil 212 induces a magnetic field within magnet 220, which drives compression tweeter 204, which is capped by a tweeter horn 236 to increase dispersion of the tweeter.

The remainder of speaker system 200 provides the woofer, for mid-to-low frequencies. Speaker system 200 also includes conventional elements, such as a back plate 216, a top plate 224, a basket 228, spider 240, cone 232, surround 244, and gasket 248.

Audio sources such as concentric driver 200 radiate pressure waves omnidirectionally at 4 π steradians. The pressure waves radiate as compression and rarefaction of the acoustic medium. This phenomenon occurs in any acoustic medium, including soundwaves in air, water, other liquids, and other media.

Most sound sources have a complex, three-dimensional pattern of radiation as a function of frequency. Objects and surfaces in the region of the sound source also create reflections and refractions that perturb or distort the soundwave. Specifically, in the case of a loudspeaker in air, the motion is primarily that of a piston. But because the wavelength can be very large or very small with respect to the piston, the motion of the piston affects the radiation pattern.

When the cone or diaphragm moves forward, the diaphragm increases the pressure in front of the cone (compression) and decreases pressure behind the cone (rarefaction). For a driver operating at frequencies for which the wavelength is large relative to the size of the cone, the positive and negative pressures cancel when measured at a distance. Therefore, loudspeakers are usually placed in an enclosure that isolates the front and rear of the radiating surface. This surface, coplanar with the driver, is referred to as the "baffle." Diffractions from the edges of a finite baffle alter the pattern of radiation.

For example, the front faces of loudspeaker 100 of FIG. 1A and loudspeaker 101 of FIG. 1B form a baffle for their respective loudspeakers.

Unlike in free air, a loudspeaker driver in a theoretical infinite baffle radiates into half space (2 π steradians). All radiation that the driver would otherwise project to the rear (e.g., behind its moving piston) is reflected through the plane of the baffle to the front. The woofer radiates wavelengths substantially larger than its piston. There is, therefore, substantial reflected radiation at and below frequencies corresponding to wavelengths on the order of the size of the radiating surface. In a woofer, for example, the wavelength of a 50 Hz tone in air at room temperature is approximately 20 feet, which is more than an order of magnitude larger than most woofer diameters. In contrast, tweeters typically reproduce sound in the approximate range of 2 kHz, with a wavelength of approximately 6 inches, up to 20 kHz, with a wavelength of approximately 0.75 inches. The wavelengths produced by the tweeters are, therefore, similar in size to the woofer.

If a loudspeaker driver is mounted in a baffle that is moving, as is the case in a coaxial tweeter mounted within a woofer, the radiation of the driver reflected from the baffle will be subject to the Doppler effect. If the baffle is moving in a sinusoidal motion at frequency $f_1$, and the driver mounted in the baffle is moving in a sinusoidal motion at frequency $f_2$, the resulting pressure waves have modulation tones at $f_2 \pm n \times f_1$, where n is a positive integer 1, 2, 3, and so on.

Any loudspeaker with a separate woofer and tweeter exhibits this effect to some extent. When a tweeter is mounted adjacent to a woofer, the woofer represents a portion of the baffle in which the tweeter is mounted, producing a predictable and measurable amount of intermodulation. But under normal circumstances, this effect is small because only a distant portion of the baffle is moving. The effect is therefore also small relative to other mechanisms of distortion. However, if the tweeter is mounted closer to the woofer, and especially if the tweeter is mounted coaxial with the woofer, the effect becomes more significant.

In the extreme case of a coaxially mounted tweeter, the distortion can be severe. In a coaxial or concentric driver configuration, the tweeter output emanates, by one of a number of arrangements, from the center of a larger woofer or mid-range driver, such that the moving piston of the lower frequency driver serves as the baffle of the higher frequency driver.

Concentric or coaxial drivers are commonly used despite the known distortion artifacts. An important attribute is that the acoustic center of the drivers is the same, assuming the two drivers are time aligned. Because natural sources of sound radiate all frequencies from a single point in space, this configuration better approximates a reproduction of real-world sound. Having separate loudspeaker drivers for different frequencies, such as separate woofers, mid-range, and tweeters, is sometimes necessary because current loudspeaker drivers have shortcomings in overcoming these Doppler shifts and other distortions.

Ideally, a single loudspeaker driver would be capable of reproducing frequencies across the entire audible spectrum. Because this is impractical with current speaker technology, coaxial drivers merge transducers capable of producing different ranges of frequencies and collocate them in space to eliminate the constructive and destructive spatial interference of the soundwaves produced in the crossover region. This can be very effective and produce an excellent sonic image. But the same configuration is the worst case scenario for Doppler modulation of the tweeter by the woofer.

In existing systems, various mechanical arrangements of low and high-frequency drivers have been used to create coaxial drivers. Some use a compression driver mounted behind the woofer that radiates through the pole piece either to a horn or using the woofer cone itself as a horn. Other designs use a small tweeter mounted directly on the pole piece of the woofer. In all cases, the woofer is effectively the baffle for the tweeter, and intermodulation results. At lower woofer excursions, the Doppler distortion can give the loudspeaker a "muddy" sound. At large woofer excursions, the effect can be clearly audible and dissonant.

A secondary factor is that when the tweeter is placed at the throat of the woofer, the cone serves as a horn for the tweeter. Normally, at the crossover, the woofer and tweeter would be moving together and their pressure output would be additive. But since the transition from the tweeter to its horn is changing with the motion of the tweeter, an additional amplitude modulation (AM) effect may occur. In summary, large motions of the woofer produce a moving baffle effect for the tweeter, resulting in Doppler modulation. This is most audible when the woofer is producing relatively low frequencies and has high excursion, and the tweeter is producing frequencies above the crossover where there is little contribution from the woofer. Also, the motion of the woofer can, in some configurations, modulate the horn transition producing an AM distortion. This is most pronounced at high woofer excursions.

Most loudspeakers do not include means for tracking the position of the woofer. It is possible, however, to do so either through modeling and prediction of cone position, or through direct or indirect measurement of the woofer cone position. If the woofer cone position is known, it is possible to use signal processing to invert the modulation effects of the woofer on the tweeter.

The present specification provides a mechanism to track or predict the motion of the radiating surface of a low-frequency driver and cancel the intermodulation effect, thereof. Signal processing may also be performed with the motion information, and the signal that would be sent to the tweeter as an input can be modified. A modified signal can be generated for one or both of the drivers to compensate for the Doppler effect and/or other modulation.

In various embodiments, the woofer motion may be sensed either with a physical sensor, or predicted using modeling and electrical feedback. The high-frequency driver may be mounted in front of the low-frequency driver, at the throat of the driver, behind the driver, or adjacent to the driver (i.e., offset or non-coaxial). The teachings of the present specification apply to all of these configurations and can reduce the modulation distortion in either case.

The signal processing used to perform the teachings of the present specification can be analog, digital, or some combination of the two.

FIG. 2B is a block diagram of a concentric speaker system 201, specifically a woofer with a concentric conventional tweeter. This speaker functions similarly to speaker system 202 of FIG. 2C. A magnet 222 is driven by a voice coil 214. Voice coil 214 receives electrical signals, and induces a magnetic field within magnet 222. This drives cone 234, which acts as a piston to reproduce audio sounds. There is also a tweeter motor 206 to reproduce high-frequency audio signals. Other conventional elements include a pole piece 210, a top plate 226, a basket 230, a spider 238, a surround 242, and a gasket 246.

FIG. 2C is a block diagram illustrating a lone woofer 202, which may be used in configurations where the woofer and tweeter are offset from one another. Note that in the example of FIG. 2C, separate woofers and tweeters are not shown. Rather, the configuration of woofer 202 may be suitably adapted to a woofer, tweeter, mid-range, or other driver by varying, well-known parameters such as the sizes or properties of the various elements.

In this case, woofer 202 includes a magnet 262 driven by a voice coil 250. Voice coil 250 receives electrical input signals, and induces a magnetic field within magnet 262. This drives cone 274, which acts as a piston to reproduce audio sounds. Other conventional elements include a pole piece 254, a back plate 258, a top plate 266, a basket 270, a spider 278, a surround 282, and a gasket 286.

In configurations where the separate woofer and tweeter are not coaxially mounted as in concentric driver 200 of FIG. 2A, a plurality of drivers adapted to various frequency ranges may be arranged throughout the speaker system. Such a configuration is illustrated in speaker 101 of FIG. 1B.

Figure 3:
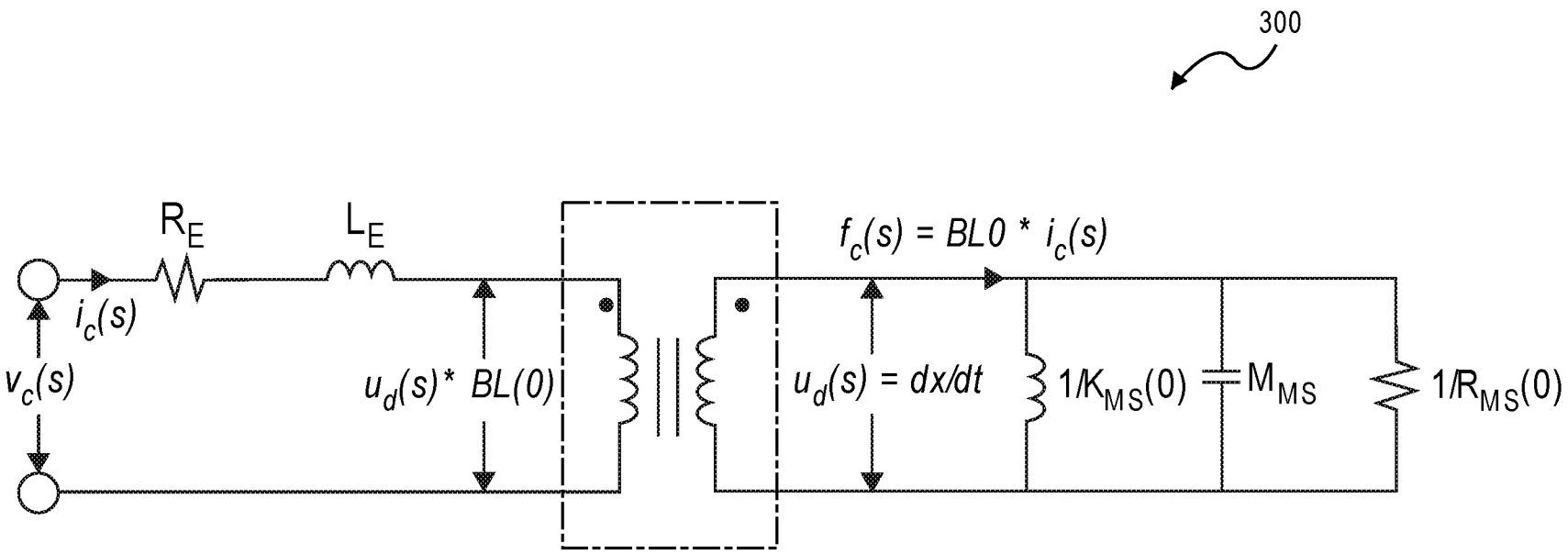
FIG. 3 includes a schematic of an electrical model of a speaker system.

FIG. 3 includes a schematic 300 of an electrical model of a speaker system. One of the most widely used types of loudspeakers today is the dynamic speaker. When input from an audio speaker is applied to the voice coil as a form of AC current, the voice coil and the constant magnetic field formed by a permanent magnet surrounding the voice coil are moved by an electromagnetic force. The diaphragm attached to the voice coil pushes the air to create soundwaves. This type of speaker can be modeled reasonably well with the second-order lumped-element single degree of freedom (SDOF) system illustrated in schematic 300.

In this model, the relationship between the applied voltage and the resulting current can be expressed in a closed form as follows:

$$\frac{v_c(s)}{i_c(s)} = Re + sLe(x) + \frac{Bl(x)^2}{s^2Mms + sRms + Kms(x)}$$

Note that for simplicity, this equation is for a woofer alone, and does not include additional terms for a sealed enclosure. A sealed enclosure may introduce additional terms, which may need to be modeled according to the specific design of the sealed enclosure.

Loudspeakers are naturally housed in an enclosure, and the model above is valid for this sealed enclosure. Enclosures with a port or a vent, such as a bass reflex port, may require additional elements in the model to emulate the behavior of the loudspeaker. Such models are well-known, and for purposes of the present disclosure as well as for simplicity of the model disclosed herein, a term for a bass reflex port is not included in the present model.

Nonlinearity of loudspeakers is usually modeled by a variation of BI, Kms, and Le, depending on the position of the diaphragm. These can be modeled as polynomials of excursion as follows:

$$Bl(x)=Bl_0+Bl_1*x+Bl_2*x^2+Bl_3*x^3+Bl_4*x^4$$

$$Kms(x)=Kms_0+Kms_1*x+Kms_2*x^2+Kms_3*x^3+Kms_4*x^4$$

$$Le(x)=Le_0+Le_1*x+Le_2*x^2+Le_3*x^3+Le_4*x^4$$

The principle of linearization is to determine non-linear elements of the system and apply compensation algorithms to the audio signal, to pre-distort the signal and linearize the nonlinearity of the loudspeaker.

Figure 4:
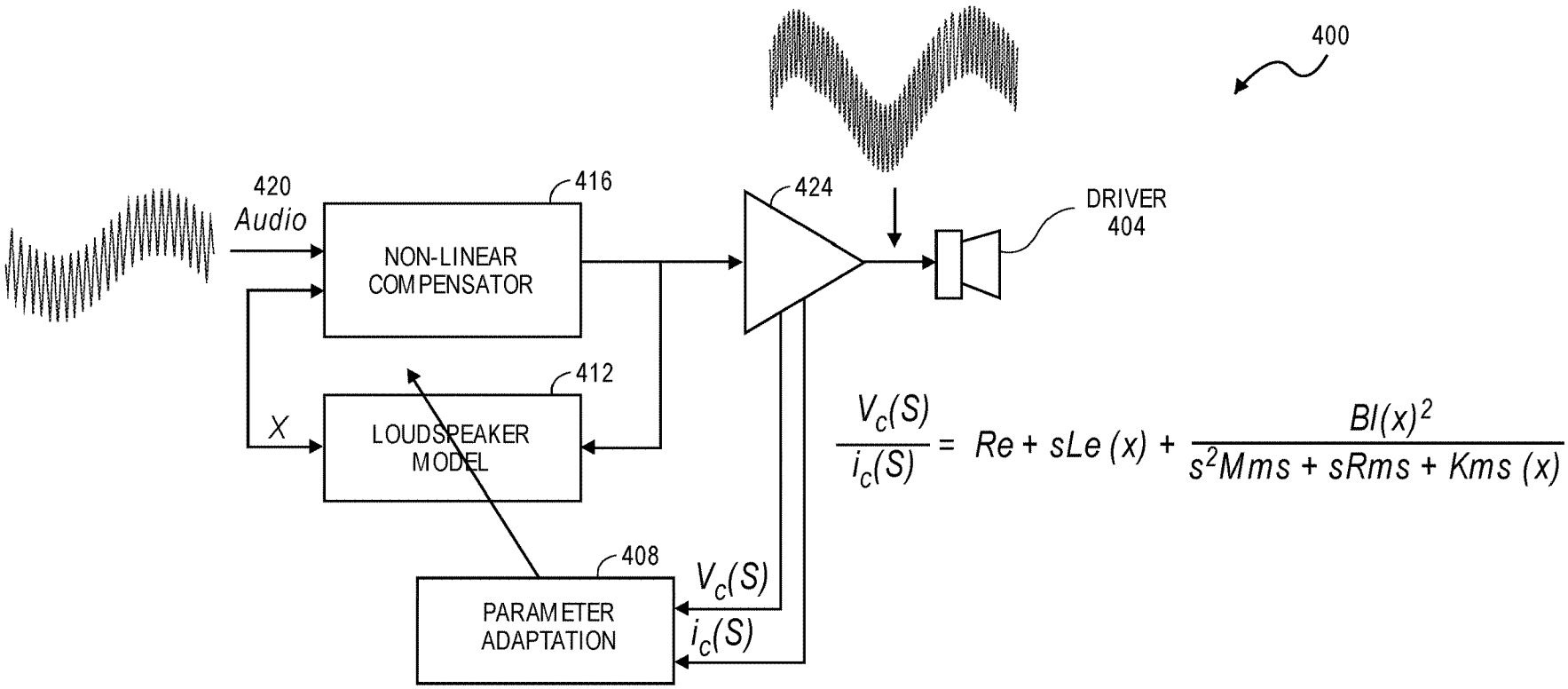
FIG. 4 is a block diagram of one possible implementation of a linearization subsystem.

FIG. 4 is a block diagram of one possible implementation of a linearization subsystem 400. In this case, a non-linear compensation circuit 420 receives the audio input, drives the audio, and performs a linearization compensation on the audio input signal. The compensated audio signal is driven to audio power amplifier 424, and audio power amplifier 424 provides the linearized output to driver 404.

To provide the linearization, a loudspeaker model 412 is used to compute nonlinearities and compensatory linearization factors, based on parameter adaptation 408. As discussed above, these can be represented by the following model:

$$\frac{v_c(s)}{i_c(s)} = Re + sLe(x) + \frac{Bl(x)^2}{s^2Mms + sRms + Kms(x)}$$

A discrete time model of the system may be derived from the continuous time model using a bilinear transformation. For example, a second-order infinite impulse response (IIR) system may be used to model the linear behavior of the system, and continuous real-time adaptation may be implemented to track changes over time and device variations. A state space model may be used to describe the system with a set of first-order differential equations, and may provide a means for discrete time modeling of the speaker from the continuous time model. One benefit of the state space model is the ability to apply non-linear behaviors of the key speaker parameters. A linear discrete time model may be used to adapt the linear parameters, and use the state space non-linear model to predict and compensate the non-linear behavior.

These non-linear coefficients may be characterized in a laboratory facility to measure excursions, for example with lasers. They need not be updated by an adaptive filter. However, there is a possibility to update the non-linear parameters on-site, based on feedback voltage and current.

Figure 5:
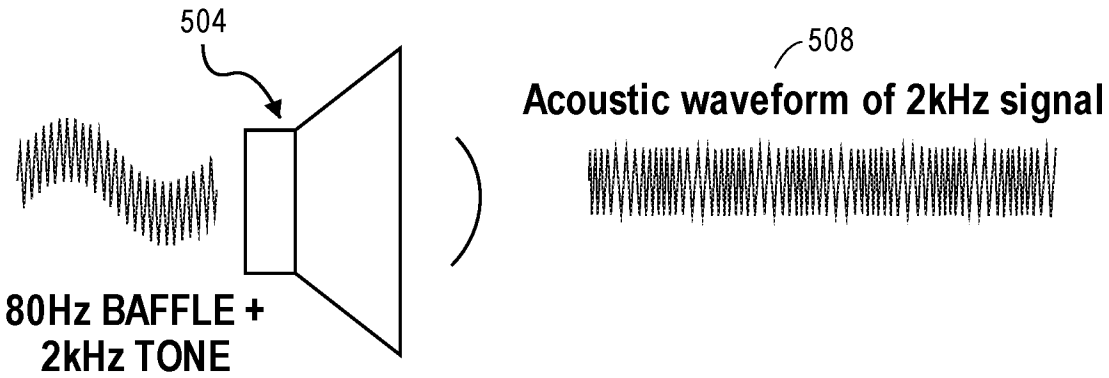
FIG. 5 is an illustration of modulation of an acoustic waveform.

FIG. 5 is an illustration of modulation of an acoustic waveform. This FIG. illustrates the concept of Doppler distortion. Doppler distortion can occur when a high-frequency tone is reflected off of a moving baffle, such as off of a woofer that is coaxial with a tweeter. For example, a 2 kHz tone may reflect off of a vibrating baffle that is generating an 80 Hz tone. The low-frequency tone results in a significant degree of excursion in the low-frequency driver, while the excursion of the high-frequency driver is relatively negligible.

In this illustration, speaker 504 generates a 2 kHz tone that reflects off of a baffle vibrating at 80 Hz. This results in waveform 508, in which it is seen that modulations are introduced into the 2 kHz signal.

The movement of the baffle causes a periodic time shift, which moves the apparent point source of the 2 kHz tone back and forth periodically, as perceived by a human user.

The sound of the 2 kHz signal when modulated by an 80 Hz baffle may be expressed as:

$$y(t) = A_{2KHz}\cos\left(2\pi f_{2KHz}\left(t + \cos(2\pi f_{80Hz}t) * \frac{Aexcursion}{Vsound}\right)\right)$$

Aexcursion is the peak excursion of the 80 Hz baffle, and Vsound is the speed of sound (approximately 340 meters per second in room temperature air).

With this example speaker, the peak excursion at −60 decibel (dB) audio signal is 2.73 mm, which translates to a time delay of 8 microseconds (μs).

Doppler distortion can be compensated for by isolating high-frequency signals and low-frequency signals with a crossover filter in a digital signal processor (DSP), and compensating the time shift to the high-frequency tone. This can be done by varying the high-frequency tone, which is particularly useful in the case of concentric drivers, where substantially all of the tone may be modulated by the vibrating baffle. In cases of offset speakers, it may be more suitable to cancel the reflected waveforms, because a large percentage of the waveform generated by the tweeter still reaches the user, even if that reflected off of the woofer is canceled.

Figure 6:
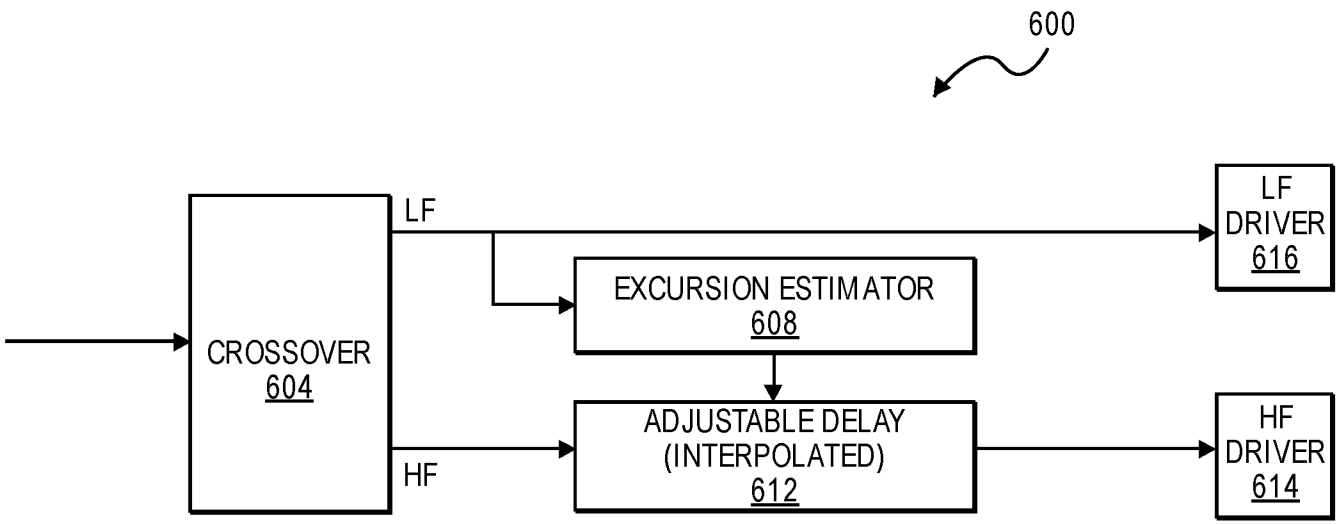
FIG. 6 is a block diagram of a control circuit.

FIG. 6 is a block diagram of a control circuit 600. Control circuit 600 includes a crossover network 604. Crossover network 604 may already exist within the system, as crossover networks are generally required for speaker systems that drive separate woofers, tweeters, or other limited-spectrum drivers. Crossover network 604 may be either an active crossover network or a passive crossover network, and may include a two-way, three-way, or other crossover network. In general, crossover network 604 may be an n-way crossover network, and may be implemented either actively or passively. Furthermore, crossover network 604 may include software and/or hardware. In this embodiment, a passive crossover network splits the audio signal after it is amplified by a single power amplifier. In an active speaker system, the crossover comes before the amplifiers, and one amplifier is required for each driver.

The amplified signal is then sent to two or more driver types, each of which represents a different frequency range. In an active crossover network, there are active components in the filters. Active crossover networks may employ active devices such as operational amplifiers, and may be operated at levels suited to power amplifier inputs.

Crossover network 604 provides a high-frequency signal and a low-frequency signal. The low-frequency signal may be driven directly to a low-frequency driver 616. The high-frequency signal is provided to an adjustable delay block 612. Excursion estimator 608 receives the low-frequency signal information, and estimates the excursion of the low-frequency driver, which provides the moving baffle for the high-frequency signal. Adjustable delay block 612 estimates an adjustable delay for the high-frequency signal to compensate for the movement of the low-frequency baffle. This signal is then driven to high-frequency driver 614. The sound from HF driver 614 and LF driver 616 mixes in the air, and presents to the listener as a single audio signal.

Note that in this example, an embodiment is illustrated in which the high-frequency signal is adjusted to compensate for the movement of the low-frequency driver acting as a baffle to the high-frequency output. This is not possible in every instance. In other cases, adjustable delay 612 may be inserted into low-frequency driver 616. This is to cancel the distorted sound of audio reflecting off of LF driver 616. Such a configuration may be particularly suitable in a case where the speakers are not concentric, and wherein it is desirable to completely cancel the distorted audio of the reflection. In cases of concentric or coaxial drivers, it may not be suitable to cancel the entire reflected signal, and instead it may be desirable to build a compensating factor, so that the reflected signal presents to the end user as a non-distorted audio signal. This may be accomplished by inserting the adjustable delay into HF driver 614.

Figure 7:
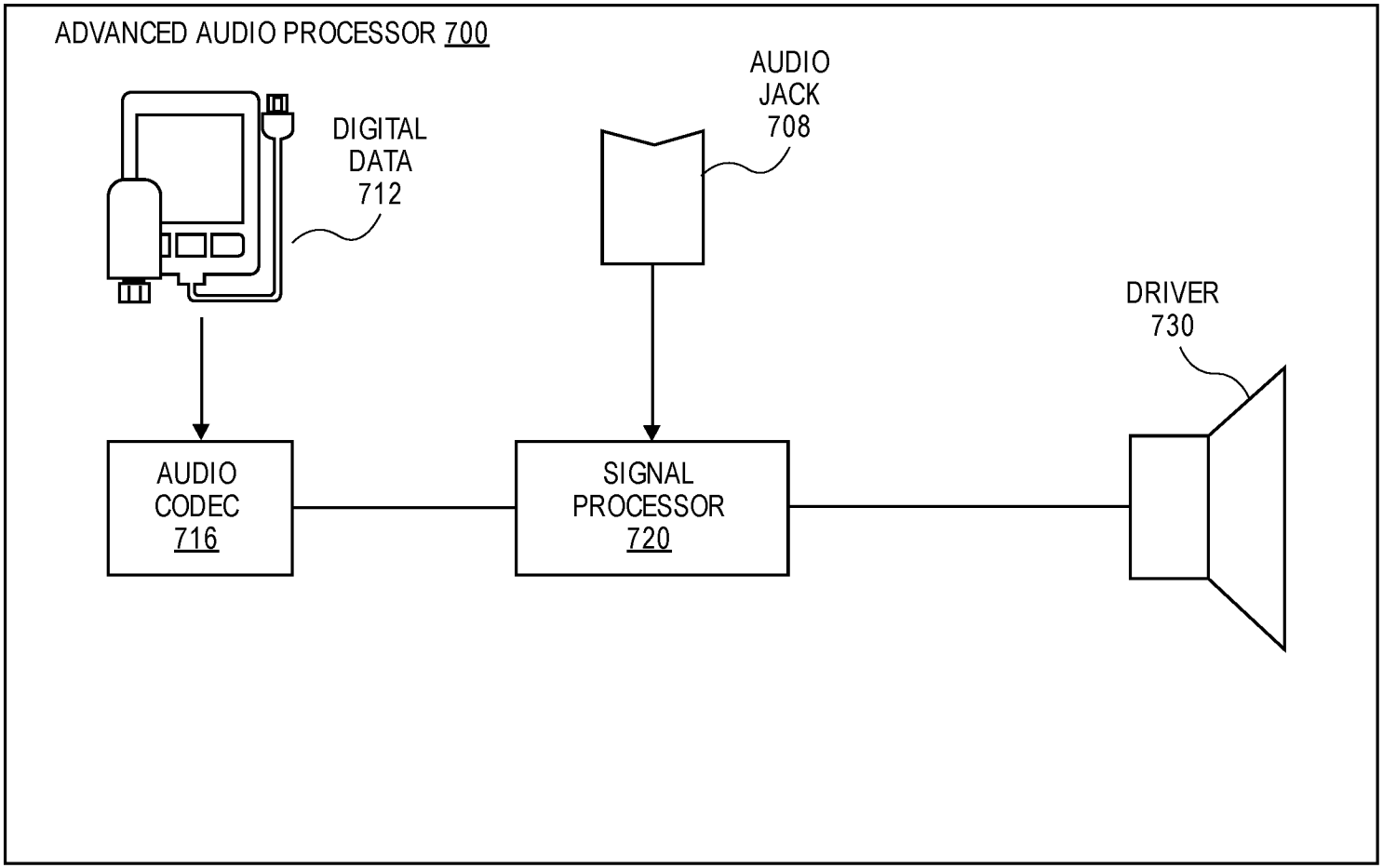
FIG. 7 is a block diagram of an advanced audio processor.

FIG. 7 is a block diagram of an advanced audio processor 700. Advanced audio processor 700 may be an embodiment of a speaker system, or any other suitable circuit or structure.

Advanced audio processor 700 includes a driver 730, which drives the actual audio waveform out to the user for listening. Note that driver 730 is illustrated here as a driver of an advanced audio processor 700, but could be any suitable sinusoidal waveform driver. This could be an audio driver, a mechanical driver, or an electrical signal driver. Similarly, although advanced audio processor 700 is provided as an illustrative application of the teachings of the present specification, it should be understood as a nonlimiting example. Other applications include, by way of illustrative example, home entertainment center speakers, portable speakers, concert speakers, a cell phone, a smart phone, a portable MP3 player, any other portable music player, a tablet, a laptop, or a portable video device. Non-entertainment applications may include a device used in the medical arts, a device used for communication, a device used in a manufacturing context, a pilot headset, an amateur radio, any other kind of radio, a studio monitor, a music or video production apparatus, a Dictaphone, or any other device to facilitate the electronic conveyance of audio signals.

In the remainder of the description for FIG. 7, it is assumed that teachings herein are embodied in an advanced audio processor 700.

Advanced audio processor 700 includes an audio jack 708, which is used to receive direct analog audio input. In cases where analog audio input is received, the analog data are provided directly to signal processor 720, and signal processing is performed on the audio. Note that this may include converting the signal to a digital format, as well as encoding, decoding, or otherwise processing the signal. Note that in some cases, signal processing is performed in the analog domain rather than in the digital domain.

In some cases, advanced audio processor 700 also includes a digital data interface 712. Digital data interface 712 may be, for example, a USB, Ethernet, Bluetooth, or other wired or wireless digital data interface. When digital audio data are received in advanced audio processor 700, the data cannot be processed directly in the analog domain. Thus, in that case, data may be provided to an audio codec 716, which can provide encoding and decoding of audio signals, and in some cases converts analog domain audio data to digital domain audio data that can be processed in the digital domain in signal processor 720.

Figure 8:
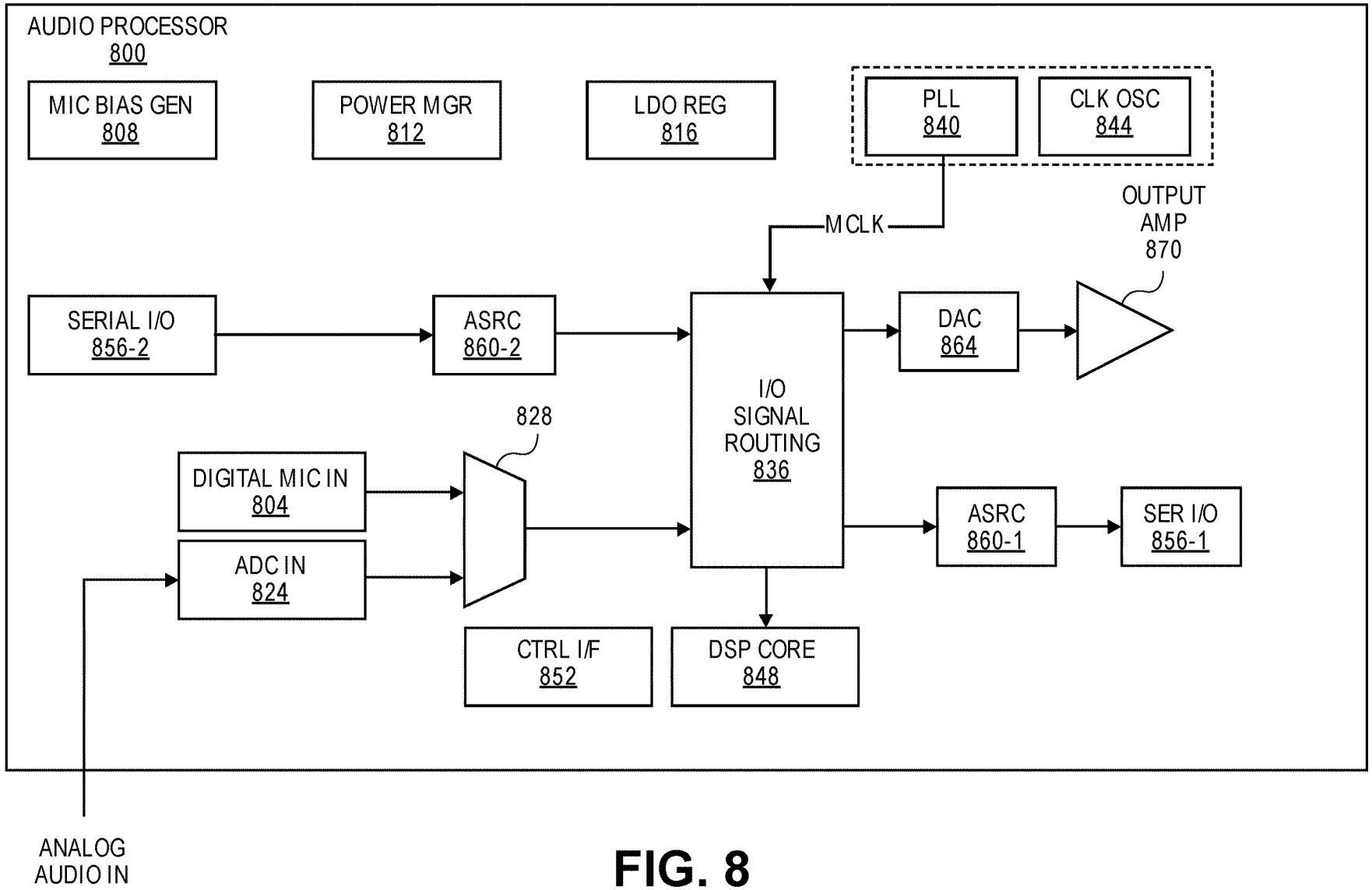
FIG. 8 is a block diagram illustrating selected elements of an audio processor.

FIG. 8 is a block diagram illustrating selected elements of an audio processor 800. Audio processor 800 is an example of a circuit or an application that can derive benefits from the teachings of this specification, including the coaxial and offset speakers described herein.

Only selected elements of audio processor 800 are shown here. This is for simplicity of the drawing, and to illustrate applications for certain components. The use of certain components in this FIGURE is not intended to imply that those components are necessary, and the omission of certain components is not intended to imply that those components must be omitted. Furthermore, the blocks shown herein are generally functional in nature, and may not represent discrete or well-defined circuits in every case. In many electronic systems, various components and systems provide feedback and signals to one another, so that it is not always possible to determine exactly where one system or subsystem ends and another one begins.

By way of illustrative example, audio processor 800 includes a microphone bias generator 808, that generates a DC bias for microphone input. This is for an embodiment that has both a microphone and a speaker, such as a headset, and microphone bias generator 808 helps to ensure that the microphone operates at the correct voltage.

A power manager 812 provides power conditioning, a steady voltage supply such as a DC output voltage, and power distribution to other system components.

Low-dropout (LDO) voltage regulator 816 is a voltage regulator that helps to ensure proper voltage is provided to other system components.

A phase-locked loop (PLL) 840 and clock oscillator 844 together may provide mclk, the local clock signal for operation within the circuit. Note that while PLL 840 can be a filterless digital PLL, it may also be a simple analog PLL of a more traditional design.

Analog-to-digital converter (ADC) input modulator 824 receives a signal from an analog audio source, and generates an output signal that is multiplexed with a signal from digital microphone input 804.

I/O signal routing 836 provides routing of signals between various components of audio processor 800. I/O signal routing 836 provides a digital audio output signal to digital-to-analog converter (DAC) 864, which converts the digital audio to analog audio, then drives the analog audio to output amplifier 870, which drives the audio waveform onto a driver.

A DSP core 848 receives input/output signals, and provides audio processing. DSP core 848 can include biquad filters, limiters, volume controls, and audio mixing, by way of illustrative and nonlimiting example. The audio processing can include encoding, decoding, active noise cancellation, audio enhancement, and other audio processing techniques. A control interface 852 is provided for control of internal functions, which in some cases are user selectable. Control interface 852 may also provide a self-boot function.

Audio processor 800 also includes an asynchronous sample rate converters (ASRCs) 860-1 and 860-2, which in some examples can be bi-directional ASRCs. A bi-directional ASRC includes both an input ASRC and an output ASRC, and may include distinct embodiments of an ASRC. ASRCs 860-1 and 860-2 may in some examples include one or more filterless digital PLLs. ASRCs 860-1 and 860-2 also include serial I/O ports 856-1 and 856-2, respectively, which enable ASRCs 860-1 and 860-2 to communicate with outside systems.

Note that the activities discussed above with reference to the FIGURES are applicable to any integrated circuit that involves audio signal processing, and may be further combined with circuits that perform other species of signal processing (for example, gesture signal processing, video signal processing, audio signal processing, analog-to-digital conversion, digital-to-analog conversion), particularly those that can execute specialized software programs or algorithms, some of which may be associated with processing digitized real-time data. Certain embodiments can relate to multi-DSP, multi-ASIC, or multi-SoC signal processing, floating point processing, signal/control processing, fixed-function processing, microcontroller applications, etc. In certain contexts, the features discussed herein can be applicable to audio headsets, noise canceling headphones, earbuds, studio monitors, computer audio systems, home theater audio, concert speakers, and other audio systems and subsystems. The teachings herein may also be combined with other systems or subsystems, such as medical systems, scientific instrumentation, wireless and wired communications, radar, industrial process control, audio and video equipment, current sensing, instrumentation (which can be highly precise), and other digital-processing-based systems.

Moreover, certain embodiments discussed above can be provisioned in digital signal processing technologies for audio or video equipment, medical imaging, patient monitoring, medical instrumentation, and home healthcare. This could include, for example, pulmonary monitors, accelerometers, heart rate monitors, or pacemakers, along with peripherals therefor. Other applications can involve automotive technologies for safety systems (e.g., stability control systems, driver assistance systems, braking systems, infotainment and interior applications of any kind). Furthermore, powertrain systems (for example, in hybrid and electric vehicles) can use high-precision data conversion, rendering, and display products in battery monitoring, control systems, reporting controls, maintenance activities, and others. In yet other example scenarios, the teachings of the present disclosure can be applicable in the industrial markets that include process control systems that help drive productivity, energy efficiency, and reliability. In consumer applications, the teachings of the signal processing circuits discussed above can be used for image processing, auto focus, and image stabilization (e.g., for digital still cameras, camcorders, etc.). Other consumer applications can include audio and video processors for home theater systems, DVD recorders, and high-definition televisions. Yet other consumer applications can involve advanced touch screen controllers (e.g., for any type of portable media device). Hence, such technologies could readily part of smartphones, tablets, security systems, PCs, gaming technologies, virtual reality, simulation training, etc.

EXAMPLE IMPLEMENTATIONS

The following examples are provided by way of illustration.

There is disclosed in one example an audio processor, comprising: an audio crossover to separate a first frequency band from a second frequency band, the first frequency band having a lower frequency band than the second frequency band; an excursion estimator to estimate from information of the first frequency band a predicted excursion of a low-frequency driver; an interpolator to interpolate an adjustment to the second frequency band to compensate for the estimated excursion; and circuitry to drive the adjusted second frequency to a receiver.

There is further disclosed an example audio processor, wherein the receiver is a high-frequency driver.

There is further disclosed an example audio processor, further comprising circuitry to drive the first frequency to a low-frequency driver.

There is further disclosed an example audio processor, wherein the interpolator comprises logic to compute a Doppler compensation for reflection of audio waveforms from the high-frequency driver off of the low-frequency driver.

There is further disclosed an example audio processor, wherein the interpolator comprises a mathematical model of a loudspeaker system containing the audio processor.

There is further disclosed an example audio processor, wherein the model of the loudspeaker system comprises a concentric speaker system, wherein a high-frequency driver is concentric with a low-frequency driver.

There is further disclosed an example audio processor, wherein the interpolator is to compute an audio waveform to cancel high-frequency waveforms reflected off of the moving low-frequency driver.

There is further disclosed an example audio processor, wherein the model of the loudspeaker system comprises an offset speaker system, wherein a high-frequency driver is offset from a low-frequency driver.

There is further disclosed an example audio processor, wherein the interpolator is to compute an audio waveform to cancel high-frequency waveforms reflected off of the moving low-frequency driver.

There is further disclosed an example audio processor, further comprising a linearization subsystem.

There is further disclosed an example audio processor, wherein the linearization subsystem comprises a loudspeaker model in a feedback loop with a non-linear compensator.

There is further disclosed an example audio processor, further comprising circuitry to drive the first frequency to a low-frequency driver unmodified.

There is further disclosed an example integrated circuit comprising the audio processor of several of the above examples.

There is further disclosed an example system-on-a-chip comprising the audio processor of several of the above examples.

There is further disclosed an example of a discrete electronic circuit comprising the audio processor of several of the above examples.

There is also disclosed an example loudspeaker system, comprising: a woofer; a tweeter; and an audio processing circuit configured to: separate a low-frequency band from a high-frequency band; estimate from the low-frequency band an expected excursion of the woofer in response to the low-frequency band; compute an adjustment to the high-frequency band to compensate for reflection of a high-frequency audio signal from the tweeter off of the woofer moving at the estimated excursion; drive the low-frequency band to the woofer; and drive the adjusted high-frequency band to the tweeter.

There is further disclosed an example loudspeaker system, wherein the audio processor circuit is configured to drive the low-frequency band to the woofer unadjusted.

There is further disclosed an example loudspeaker system, wherein the audio processor circuit is further configured to compute a Doppler compensation for reflection of audio waveforms from the high-frequency driver off of the low-frequency driver.

There is further disclosed an example loudspeaker system, wherein the audio processor circuit provides a mathematical model of the loudspeaker system.

There is further disclosed an example loudspeaker system, wherein the tweeter is concentric with the woofer.

There is further disclosed an example loudspeaker system, wherein the audio processor circuit is configured to compute an audio waveform to cancel high-frequency waveforms reflected off of the moving woofer.

There is further disclosed an example loudspeaker system, wherein the audio processor circuit is configured to compute an audio waveform to cancel high-frequency waveforms reflected off of the moving woofer.

There is further disclosed an example loudspeaker system, wherein the audio processor circuit comprises a linearization subsystem.

There is further disclosed an example loudspeaker system, wherein the linearization subsystem comprises a loudspeaker model in a feedback loop with a non-linear compensator.

There is also disclosed an example method of performing audio processing for a loudspeaker system, comprising: separating a first frequency band from a second frequency band, the first frequency band having a lower frequency band than the second frequency band; estimating from the first frequency band a predicted excursion of a low-frequency driver; interpolating an adjustment to the second frequency band to compensate for the predicted excursion; and driving the adjusted first frequency band to a high-frequency driver.

There is further disclosed an example method, further comprising driving the first frequency to a low-frequency driver.

There is further disclosed an example method, wherein interpolating comprising computing a Doppler compensation for reflection of audio waveforms from the high-frequency driver off of the low-frequency driver.

There is further disclosed an example method, further comprising computing a mathematical model of the loudspeaker system.

There is further disclosed an example method, wherein the model of the loudspeaker system comprises a tweeter concentric with a woofer.

There is further disclosed an example method, wherein interpolating comprises computing an audio waveform to cancel high-frequency waveforms reflected off of the moving woofer.

There is further disclosed an example method, wherein the model of the loudspeaker system comprises a tweeter offset from a woofer.

There is further disclosed an example method, wherein interpolating comprises computing an audio waveform to cancel high-frequency waveforms reflected off of the moving woofer.

There is further disclosed an example method, further comprising computing a linearization for the loudspeaker system.

There is further disclosed an example method, wherein computing the linearization comprises applying a loudspeaker model in a feedback loop with a non-linear compensator.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The particular embodiments of the present disclosure may readily include a system-on-chip (SoC) central processing unit (CPU) package. An SoC represents an integrated circuit (IC) that integrates components of a computer or other electronic system into a single chip. It may contain digital, analog, mixed-signal, and radio frequency functions: all of which may be provided on a single chip substrate. Other embodiments may include a multi-chip-module (MCM), with a plurality of chips located within a single electronic package and configured to interact closely with each other through the electronic package. Any module, function, or block element of an ASIC or SoC can be provided, where appropriate, in a reusable "black box" intellectual property (IP) block, which can be distributed separately without disclosing the logical details of the IP block. In various other embodiments, the digital signal processing functionalities may be implemented in one or more silicon cores in application specific integrated circuits (ASICs), field programmable gate arrays (FPGAs), and other semiconductor chips.

In some cases, the teachings of the present specification may be encoded into one or more tangible, non-transitory computer-readable mediums having stored thereon executable instructions that, when executed, instruct a programmable device (such as a processor or DSP) to perform the methods or functions disclosed herein. In cases where the teachings herein are embodied at least partly in a hardware device (such as an ASIC, IP block, or SoC), a non-transitory medium could include a hardware device hardware-programmed with logic to perform the methods or functions disclosed herein. The teachings could also be practiced in the form of Register Transfer Level (RTL) or other hardware description language such as VHDL or Verilog, which can be used to program a fabrication process to produce the hardware elements disclosed.

In example implementations, at least some portions of the processing activities outlined herein may also be implemented in software. In some embodiments, one or more of these features may be implemented in hardware provided external to the elements of the disclosed figures, or consolidated in any appropriate manner to achieve the intended functionality. The various components may include software (or reciprocating software) that can coordinate in order to achieve the operations as outlined herein. In still other embodiments, these elements may include any suitable algorithms, hardware, software, components, modules, interfaces, or objects that facilitate the operations thereof.

Additionally, some of the components associated with described microprocessors may be removed, or otherwise consolidated. In a general sense, the arrangements depicted in the figures may be more logical in their representations, whereas a physical architecture may include various permutations, combinations, and/or hybrids of these elements. It is imperative to note that countless possible design configurations can be used to achieve the operational objectives outlined herein. Accordingly, the associated infrastructure has a myriad of substitute arrangements, design choices, device possibilities, hardware configurations, software implementations, equipment options, etc.

Any suitably-configured processor component can execute any type of instructions associated with the data to achieve the operations detailed herein. Any processor disclosed herein could transform an element or an article (for example, data) from one state or thing to another state or thing. In another example, some activities outlined herein may be implemented with fixed logic or programmable logic (for example, software and/or computer instructions executed by a processor) and the elements identified herein could be some type of a programmable processor, programmable digital logic (for example, a FPGA, an erasable programmable read only memory (EPROM), an electrically erasable programmable read only memory (EEPROM)), an ASIC that includes digital logic, software, code, electronic instructions, flash memory, optical disks, CD-ROMs, DVD ROMs, magnetic or optical cards, other types of machine-readable mediums suitable for storing electronic instructions, or any suitable combination thereof. In operation, processors may store information in any suitable type of non-transitory storage medium (for example, random access memory (RAM), read only memory (ROM), FPGA, EPROM, electrically erasable programmable ROM (EEPROM), etc.), software, hardware, or in any other suitable component, device, element, or object where appropriate and based on particular needs. Further, the information being tracked, sent, received, or stored in a processor could be provided in any database, register, table, cache, queue, control list, or storage structure, based on particular needs and implementations, all of which could be referenced in any suitable timeframe. Any of the memory items discussed herein should be construed as being encompassed within the broad term 'memory.' Similarly, any of the potential processing elements, modules, and machines described herein should be construed as being encompassed within the broad term 'microprocessor' or 'processor.' Furthermore, in various embodiments, the processors, memories, network cards, buses, storage devices, related peripherals, and other hardware elements described herein may be realized by a processor, memory, and other related devices configured by software or firmware to emulate or virtualize the functions of those hardware elements.

Computer program logic implementing all or part of the functionality described herein is embodied in various forms, including, but in no way limited to, a source code form, a computer executable form, a hardware description form, and various intermediate forms (for example, mask works, or forms generated by an assembler, compiler, linker, or locator). In an example, source code includes a series of computer program instructions implemented in various programming languages, such as an object code, an assembly language, or a high-level language such as OpenCL, RTL, Verilog, VHDL, Fortran, C, C++, JAVA, or HTML for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

In the discussions of the embodiments above, the capacitors, buffers, graphics elements, interconnect boards, clocks, DDRs, camera sensors, dividers, inductors, resistors, amplifiers, switches, digital core, transistors, and/or other components can readily be replaced, substituted, or otherwise modified in order to accommodate particular circuitry needs. Moreover, it should be noted that the use of complementary electronic devices, hardware, non-transitory software, etc. offer an equally viable option for implementing the teachings of the present disclosure.

In one example embodiment, any number of electrical circuits of the FIGURES may be implemented on a board of an associated electronic device. The board can be a general circuit board that can hold various components of the internal electronic system of the electronic device and, further, provide connectors for other peripherals. More specifically, the board can provide the electrical connections by which the other components of the system can communicate electrically. Any suitable processors (inclusive of digital signal processors, microprocessors, supporting chipsets, etc.), memory elements, etc. can be suitably coupled to the board based on particular configuration needs, processing demands, computer designs, etc. Other components such as external storage, additional sensors, controllers for audio/video display, and peripheral devices may be attached to the board as plug-in cards, via cables, or integrated into the board itself. In another example embodiment, the electrical circuits of the FIGURES may be implemented as stand-alone modules (e.g., a device with associated components and circuitry configured to perform a specific application or function) or implemented as plug-in modules into application specific hardware of electronic devices.

Note that with the numerous examples provided herein, interaction may be described in terms of two, three, four, or more electrical components. However, this has been done for purposes of clarity and example only. It should be appreciated that the system can be consolidated in any suitable manner. Along similar design alternatives, any of the illustrated components, modules, and elements of the FIGURES may be combined in various possible configurations, all of which are clearly within the broad scope of this specification. In certain cases, it may be easier to describe one or more of the functionalities of a given set of flows by only referencing a limited number of electrical elements. It should be appreciated that the electrical circuits of the FIGURES and its teachings are readily scalable and can accommodate a large number of components, as well as more complicated/sophisticated arrangements and configurations. Accordingly, the examples provided should not limit the scope or inhibit the broad teachings of the electrical circuits as potentially applied to a myriad of other architectures.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke 35 U.S.C. § 112(f) as it exists on the date of the filing hereof unless the words "means for" or "steps for" are specifically used in the particular claims; and (b) does not intend, by any statement in the specification, to limit this disclosure in any way that is not otherwise reflected in the appended claims.

What is claimed is:

1. An audio processor, comprising:

an audio crossover to separate a first frequency band from a second frequency band, the first frequency band having a lower frequency band than the second frequency band;

an excursion estimator to estimate from information of the first frequency band a predicted excursion of a low-frequency driver;

an interpolator to interpolate an adjustment to the second frequency band to compensate for the estimated excursion; and circuitry to drive the adjusted second frequency band to a receiver.

2. The audio processor of claim 1, wherein the receiver is a high-frequency driver.

3. The audio processor of claim 2, further comprising circuitry to drive the first frequency band to the low-frequency driver.

4. The audio processor of claim 3, wherein the interpolator comprises logic to compute a Doppler compensation for reflection of audio waveforms from the high-frequency driver off of the low-frequency driver.

5. The audio processor of claim 1, wherein the interpolator comprises a mathematical model of a loudspeaker system containing the audio processor.

6. The audio processor of claim 5, wherein the model of the loudspeaker system comprises a concentric speaker system, wherein a high-frequency driver is concentric with the low-frequency driver.

7. The audio processor of claim 6, wherein the interpolator is configured to compute an audio waveform to cancel high-frequency waveforms reflected off of the low-frequency driver.

8. The audio processor of claim 5, wherein the model of the loudspeaker system comprises an offset speaker system, wherein a high-frequency driver is offset from the low-frequency driver.

9. The audio processor of claim 8, wherein the interpolator is configured to compute an audio waveform to cancel high-frequency waveforms reflected off of the low-frequency driver.

10. The audio processor of claim 1, further comprising a linearization subsystem.

11. The audio processor of claim 10, wherein the linearization subsystem comprises a loudspeaker model in a feedback loop with a non-linear compensator.

12. The audio processor of claim 1, further comprising circuitry to drive the first frequency band to the low-frequency driver unmodified.

13. An integrated circuit comprising the audio processor of claim 1.

14. A system-on-a-chip comprising the audio processor of claim 1.

15. A discrete electronic circuit comprising the audio processor of claim 1.

16. A loudspeaker system, comprising:

a woofer;

a tweeter; and an audio processing circuit configured to:

separate a low-frequency band from a high-frequency band;

estimate from the low-frequency band an expected excursion of the woofer in response to the low-frequency band;

compute an adjustment to the high-frequency band to compensate for reflection of a high-frequency audio signal from the tweeter off of the woofer moving at the estimated excursion;

drive the low-frequency band to the woofer; and drive the adjusted high-frequency band to the tweeter.

17. The loudspeaker system of claim 16, wherein the audio processing circuit is configured to drive the low-frequency band to the woofer unadjusted.

18. The loudspeaker system of claim 16, wherein the audio processing circuit is further configured to compute a Doppler compensation for reflection of audio waveforms from the tweeter off of the woofer.

19. A method of performing audio processing for a loudspeaker system, comprising:

separating a first frequency band from a second frequency band, the first frequency band having a lower frequency band than the second frequency band;

estimating from the first frequency band a predicted excursion of a low-frequency driver;

interpolating an adjustment to the second frequency band to compensate for the predicted excursion; and driving the adjusted second frequency band to a high-frequency driver.

20. The method of claim 19, wherein interpolating comprises computing a Doppler compensation for reflection of audio waveforms from the high-frequency driver off of the low-frequency driver.

21. The method of claim 19, further comprising:

driving the first frequency band to the low-frequency driver.

22. The method of claim 21, further comprising:

computing an audio waveform to cancel high-frequency waveforms reflected off of the low- frequency driver.

23. The method of claim 21, further comprising:

driving the first frequency band to the low-frequency driver unmodified.

24. One or more non-transitory computer-readable media having instructions stored thereon, wherein the instructions, when executed by a system, cause the system to:

separate a first frequency band from a second frequency band, the first frequency band having a lower frequency band than the second frequency band;

estimate, based at least on information of the first frequency band, a predicted excursion of a low-frequency driver;

interpolate an adjustment to the second frequency band to compensate for the estimated excursion; and drive the adjusted second frequency band to a receiver.

25. The one or more non-transitory computer-readable media according to claim 24, wherein the instructions, when executed by a system, cause the system to:

drive the first frequency band to the low-frequency driver.

26. The one or more non-transitory computer-readable media according to claim 24, wherein the instructions, when executed by a system, cause the system to:

compute a Doppler compensation for reflection of audio waveforms from the receiver off of the low-frequency driver.

27. The one or more non-transitory computer-readable media according to claim 24, wherein the instructions, when executed by a system, cause the system to:

compute an audio waveform to cancel high-frequency waveforms reflected off of the low- frequency driver.

28. The one or more non-transitory computer-readable media according to claim 24, wherein the instructions, when executed by a system, cause the system to:

drive the first frequency band to the low-frequency driver unmodified.

29. One or more non-transitory computer-readable media having instructions stored thereon, wherein the instructions, when executed by a system, cause the system to:

separate a low-frequency band from a high-frequency band;

estimate, based at least on the low-frequency band, an expected excursion of a woofer in response to the low-frequency band;

compute an adjustment to the high-frequency band to compensate for reflection of a high- frequency audio signal from a tweeter off of the woofer moving at the estimated excursion;

drive the low-frequency band to the woofer; and drive the adjusted high-frequency band to the tweeter.

30. The one or more non-transitory computer-readable media according to claim 29, wherein the instructions, when executed by a system, cause the system to:

drive the low-frequency band to the woofer unadjusted.

31. The one or more non-transitory computer-readable media according to claim 29, wherein the instructions, when executed by a system, cause the system to:

compute a Doppler compensation for reflection of audio waveforms from the tweeter off of the woofer.

32. The one or more non-transitory computer-readable media according to claim 29, wherein the instructions, when executed by a system, cause the system to:

cancel high-frequency waveforms that are reflected off of the woofer.

33. The one or more non-transitory computer-readable media according to claim 29, wherein the system comprises the tweeter being concentric with the woofer.

34. The one or more non-transitory computer-readable media according to claim 29, wherein the instructions, when executed by a system, cause the system to:

compute an audio waveform to cancel high-frequency waveforms reflected off of the woofer.

35. The one or more non-transitory computer-readable media according to claim 29, wherein the system comprises the tweeter being offset from the woofer.

36. The one or more non-transitory computer-readable media according to claim 29, wherein the system comprises two independent drivers and the woofer is a mid-to-low frequency woofer and the tweeter is a high-frequency tweeter.

37. The one or more non-transitory computer-readable media according to claim 29, wherein time shifting is applied to one or more high-frequency audio signals to compensate for misalignment of a plurality of acoustic centers of a plurality of drivers.

38. The one or more non-transitory computer-readable media according to claim 29, wherein information about one or more high-frequency signals and their expected interaction with the woofer are provided to the tweeter.

39. The one or more non-transitory computer-readable media according to claim 29, wherein a predistortion is inserted into one or more signals to the tweeter for canceling one or more reflected high-frequency waves.

* * * * *